US012552597B2

(12) United States Patent
Wierenga

(10) Patent No.: US 12,552,597 B2
(45) Date of Patent: Feb. 17, 2026

(54) PACKAGED GRAIN/SILAGE BAG

(71) Applicant: 2574718 Alberta LTD., Alberta (CA)

(72) Inventor: John Marvin Wierenga, Alberta (CA)

(73) Assignee: 2574718 Alberta LTD., Alberta (CA)

( * ) Notice: Subject to any disclaimer, the term of this patent is extended or adjusted under 35 U.S.C. 154(b) by 0 days.

(21) Appl. No.: 18/979,565

(22) Filed: Dec. 12, 2024

(65) Prior Publication Data

US 2025/0340360 A1 Nov. 6, 2025

Related U.S. Application Data

(60) Provisional application No. 63/641,121, filed on May 1, 2024.

(51) Int. Cl.

| | |
|---|---|
| ***B65D 85/64*** | (2006.01) |
| ***B65B 5/04*** | (2006.01) |
| ***B65B 63/04*** | (2006.01) |
| ***B65D 88/16*** | (2006.01) |
| ***B65D 90/48*** | (2006.01) |

(52) U.S. Cl.

CPC ..... *B65D 85/64* (2013.01); *B65B 5/04* (2013.01); *B65B 63/04* (2013.01); *B65D 88/1612* (2013.01); *B65D 90/48* (2013.01); *B65D 2585/649* (2013.01)

(58) Field of Classification Search

USPC ..... 206/459.5, 494

See application file for complete search history.

(56) References Cited

U.S. PATENT DOCUMENTS

| | | | | | |
|---|---|---|---|---|---|
| 3,119,549 | A * | 1/1964 | Schoen | B65D 33/28 | 383/200 |
| 4,044,919 | A * | 8/1977 | Olson | B65D 83/0852 | 221/63 |
| 4,453,649 | A * | 6/1984 | Origuchi | B65D 83/0811 | 221/45 |
| 4,506,801 | A * | 3/1985 | Origuchi | B65D 83/0811 | 206/390 |
| 4,597,494 | A * | 7/1986 | Benoit | B65D 83/0894 | 206/390 |
| 4,674,127 | A * | 6/1987 | Yamada | B65D 90/046 | 383/22 |
| 4,786,192 | A * | 11/1988 | Graves | B65D 77/06 | 383/119 |
| 7,552,838 | B2 * | 6/2009 | McDowell | B65D 77/06 | 220/495.01 |
| 2012/0279981 | A1 * | 11/2012 | Thomas | B65D 83/0805 | 221/1 |

* cited by examiner

*Primary Examiner* — Bryon P Gehman
(74) *Attorney, Agent, or Firm* — Volpe Koenig

(57) ABSTRACT

Systems and methods relating to the packing and packaging of bulk material bags such as grain bags and silage bags. The left and right sides of the bag are continuously folded over itself without overlapping the center of the bag. The folded bag allows for the left and right side ends to sit atop the folded left and right sides. The box containing the packed grain bag may have an external indicator indicating the center of the bag. This configuration allows for users to pull/unravel the bag easily and the indicator allows for easy alignment of the bag with the grain bagger.

12 Claims, 4 Drawing Sheets

PACKAGED GRAIN/SILAGE BAG

CROSS REFERENCE TO RELATED APPLICATIONS

The present application claims the benefit of U.S. Provisional Patent Application No. 63/641,121, filed on May 1, 2024, and titled "PACKAGED GRAIN/SILAGE BAG".

TECHNICAL FIELD

The present invention relates to agriculture related products. More specifically, the present invention relates to grain/silage bags for storing grain and silage and, more specifically, to systems and methods for packaging grain/silage bags.

BACKGROUND

Grain/silage bags have grown in popularity for storing grain and silage such that they are now one of the main methods for grain and silage storage. While storing grain in grain bags offer many advantages, such grain/silage bags can be difficult to deploy. Unpacking the grain bags can be a complicated and grueling process involving the unrolling and unraveling of the bag. As well, aligning the center (aligning with the center longitudinal axis of the deployed bag) of the unpacked grain bag to the grain bag loader can be a physically demanding task as the unrolled bag will need to be repositioned, adjusted, and aligned properly.

For clarity, a grain bag is a large, airtight bag used to store grain in a dry, controlled environment. Grain bags are a temporary storage option that can be used to keep grain safe from weather and poor storage conditions. Grain bags can be used for storage of silage instead of grain. Grain bags are, generally, elongated plastic bags that can range in size from 8 to 14 feet in diameter and from 150 feet to 500 feet in length. These bags can store 120 to 1,300 tons of silage or 4,600 to 34,000 bushels of grain.

To understand the context of the present invention, FIG. 1A illustrates multiple filled grain bags in a field. As can be seen, bulk material bags are, when deployed and full, tubular polypropylene (i.e. plastic) bags that are filled with grain, silage, or other bulk material. FIG. 1B shows a side illustration of a folded bulk material bag as configured inside a box that does not use various aspects of the present invention.

There is, therefore, a need for systems and methods that would simplify the task of grain bag or bulk material bag installation. Preferably, such systems and methods would make grain/silage bag installation simpler and less onerous for the user.

SUMMARY

The present invention provides systems, items, and methods relating to the packing and packaging of bulk material bags such as grain and/or silage bags. To package a bulk material bag, the left and right sides of the bag are continuously folded over itself without overlapping the center of the bag. The folded bag allows for the left and right side ends to sit atop the folded left and right halves. While the bag has a center indicator, the box containing the packed bag may also have an indicator indicating the center of the bag. This configuration allows for users to pull/unravel the bag easily and the indicator allows for easy alignment of the bag with a loader for grain bag implementations.

In a first aspect, there is provided a method for packing a bulk material bag into a box, said bulk material bag having a center section, a left side and a right side, the method comprising

- placing said center section of said bulk material bag in said box;
- continuously folding said left side of said bulk material bag over itself in said box such that no part of a folded left side substantially overlaps a center of said center section;
- continuously folding right side of said grain bag over itself in said box such that no part of a folded right side substantially overlaps said center;
- wherein
- after said bag is folded in said box, said folded left side is adjacent said folded right side,
- when said bag is to be deployed, both of said end of said left side and said end of said right side are accessible to a user such that unfolding both of said folded left side and said folded right side by way of said end of said left side and said end of said right side stretches said bulk material bag in a width-wise manner.

In a second aspect, there is provided a method for packing a grain bag, said grain bag having a center, a left half and a right half, and a left end side and a right end side, the method comprising:

- placing said grain bag such that said center is centered;
- continuously folding said left half over itself such that no part of a folded left half overlaps said center;
- continuously folding right left half over itself such that no part of a folded right half overlaps said center;
- ensuring that said folded left half is adjacent said folded right half;
- ensuring that said left end side for said left half is on top of said folded left half;
- ensuring that said right end side for said right half is on top of said folded right half to result in a folded grain bag; and
- packing said folded grain bag in a container such that when said container is opened, both of said left end side and said right end side are accessible to a user.

In a third aspect, there is provided a packed bulk material bag package in a box, said package comprising:

- a bulk material bag in said box wherein said bag comprises:
- a center section having a center;
- a left side that is folded over itself in said box such that no part of a folded left side substantially overlaps said center;
- a right side that is folded over itself in said box such that no part of a folded right side substantially overlaps said center;
- wherein
- a resulting folded grain bag in said box is packed such that when bag is to be deployed, both of said end of said left side and said end of said right side are accessible to a user.

Yet another aspect of the present invention provides that, after said bag is folded in said box, an end of said left side is on top of said folded left side and an end of said right side is on top of said folded right side.

In a further aspect, method further comprises a step of placing a divider between said folded left half and said folded right half. The divider may be placed substantially adjacent said center of said center section. As well, the box may be substantially rigid.

Yet a further aspect of the present invention provides that the box has an indicator of a location of said center.

In further aspects of the present invention, the bulk material bag is a grain bag while in other aspects of the present invention, the bulk material is a silage bag. The center of the package may coincide with a central longitudinal axis of a deployed bag.

In some implementations, the various aspects of the present invention comprises of a divider between said folded left half and said folded right half. The divider may be placed substantially at a center of said center section. In addition, in some implementations, folded bag has a center indicator to indicate a center of said bag. Preferably, the center of said bag generally aligns with a central longitudinal axis of a deployed bag. As well, in some implementations, the bag has a stretch indicator that is visible to a user when said bag is deployed and is being filled.

In further aspects, the package of the present invention further comprises an end of said left side that is on top of said folded left side; and an end of said right side that is on top of said folded right side.

BRIEF DESCRIPTION OF THE DRAWINGS

The embodiments of the present invention will now be described by reference to the following figures, in which identical reference numerals in different figures indicate identical elements and in which.

DETAILED DESCRIPTION

It should be clear that any reference to bags in this document should be read as a reference to both grain bags and silage bags and to any bags for use in storing bulk materials.

Figure 1A:
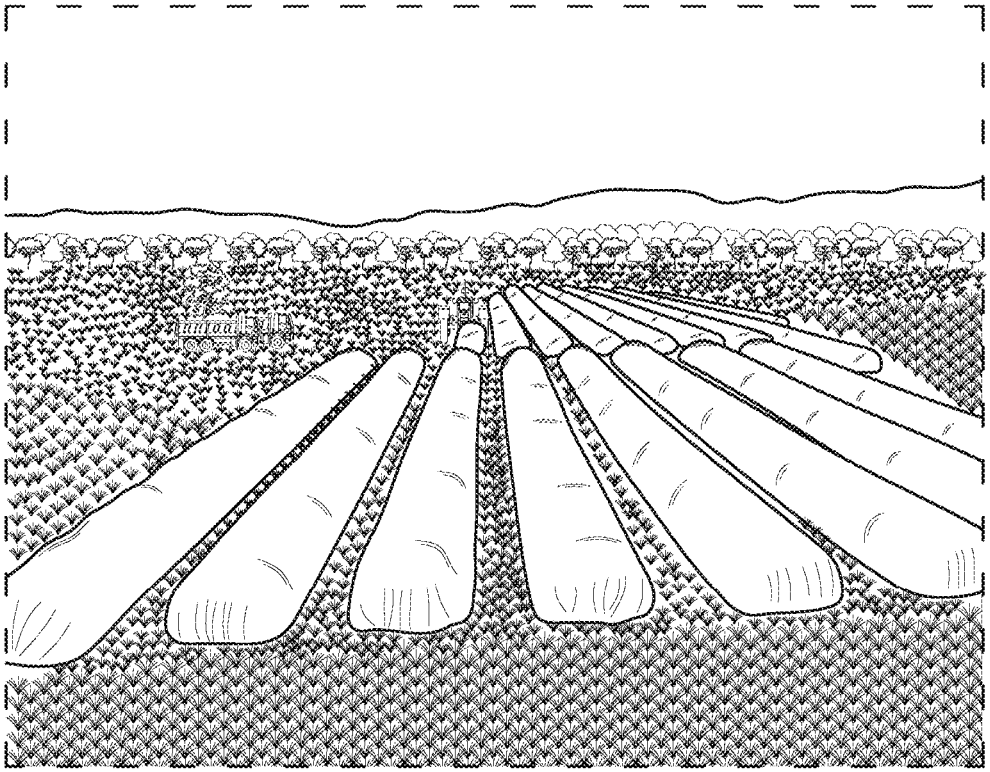
FIG. 1A is an illustration of multiple filled bulk material bags in a field after deployment.
Figure 1B:
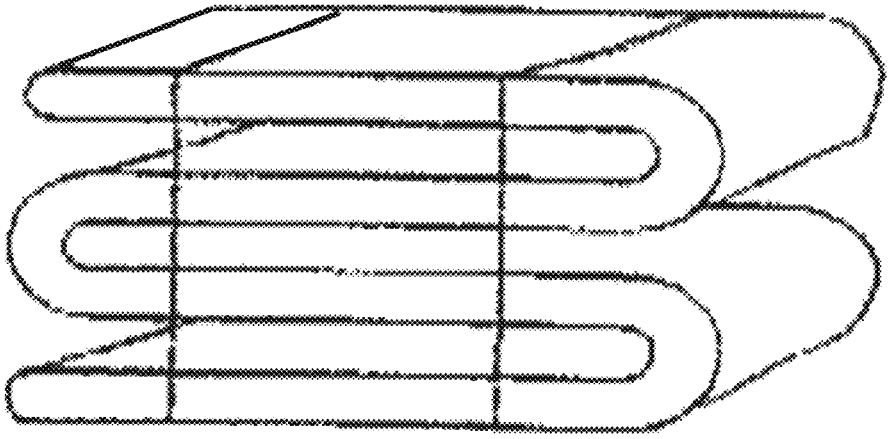
FIG. 1B is an illustration of a folded bulk material bag as folded and packed inside a box according to the prior art.
Figure 2:
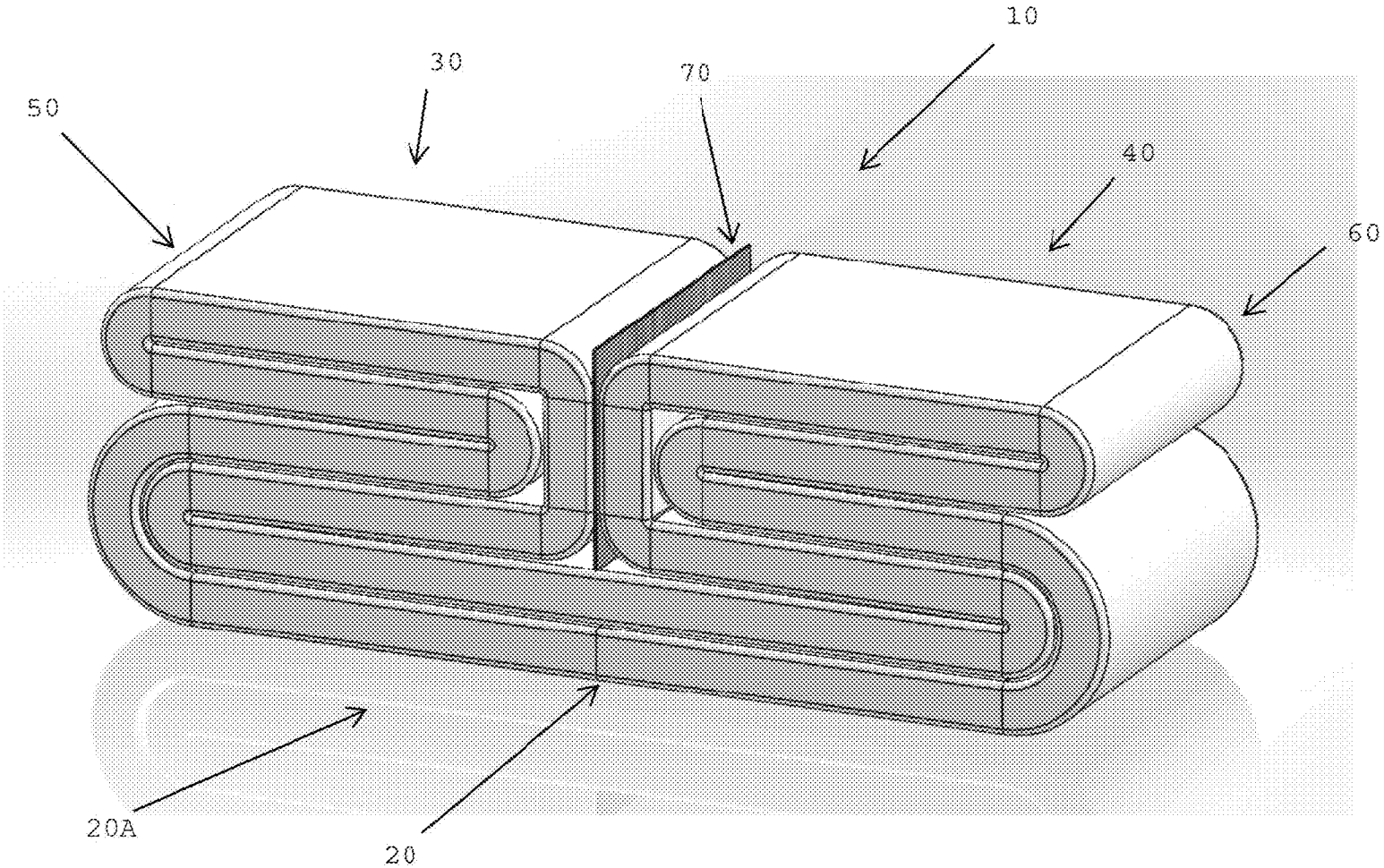
FIG. 2 is an isometric view of a packed bulk material bag according to one aspect of the present invention.

Referring to FIG. 2, an isometric view of a packed bulk material bag is illustrated. As can be seen, the bag 10 has a center section 20A having a center 20, a left side 30, and a right side 40. On the left side 30 is a left end side 50 and on the right side 40 is a right end side 60. From the Figure, it can be seen that the left side is folded continuously over itself and that the right side is similarly continuously folder over itself as well. However, it should be clear that neither the folded left side nor the folded right side overlaps the center 20 of the center section 20A. The left and right sides are folded such that the left end side is atop the folded left side and the right end side is atop the folded right side.

It should be noted that a divider 70 may be placed between the folded left side and the folded right side to separate these two. Preferably, the divider 70 is placed substantially adjacent to or in approximately the same position as the center 20. It should also be noted that the packed bag is packed such that the left end side and the right end side are both accessible to a user after the user has opened a box/container containing the packed bag. Also preferably, the box/container, when closed, has an indicator indicating the center 20 of the bag inside the container. This way, the sealed box/container can be aligned with the grain bag loader such that, when the box/container is opened, no further aligning is needed of the bag's center 20 with the grain loader. Of course, it is preferred that the box opens such that the left end side and the right end side are accessible to the user.

Figure 3:
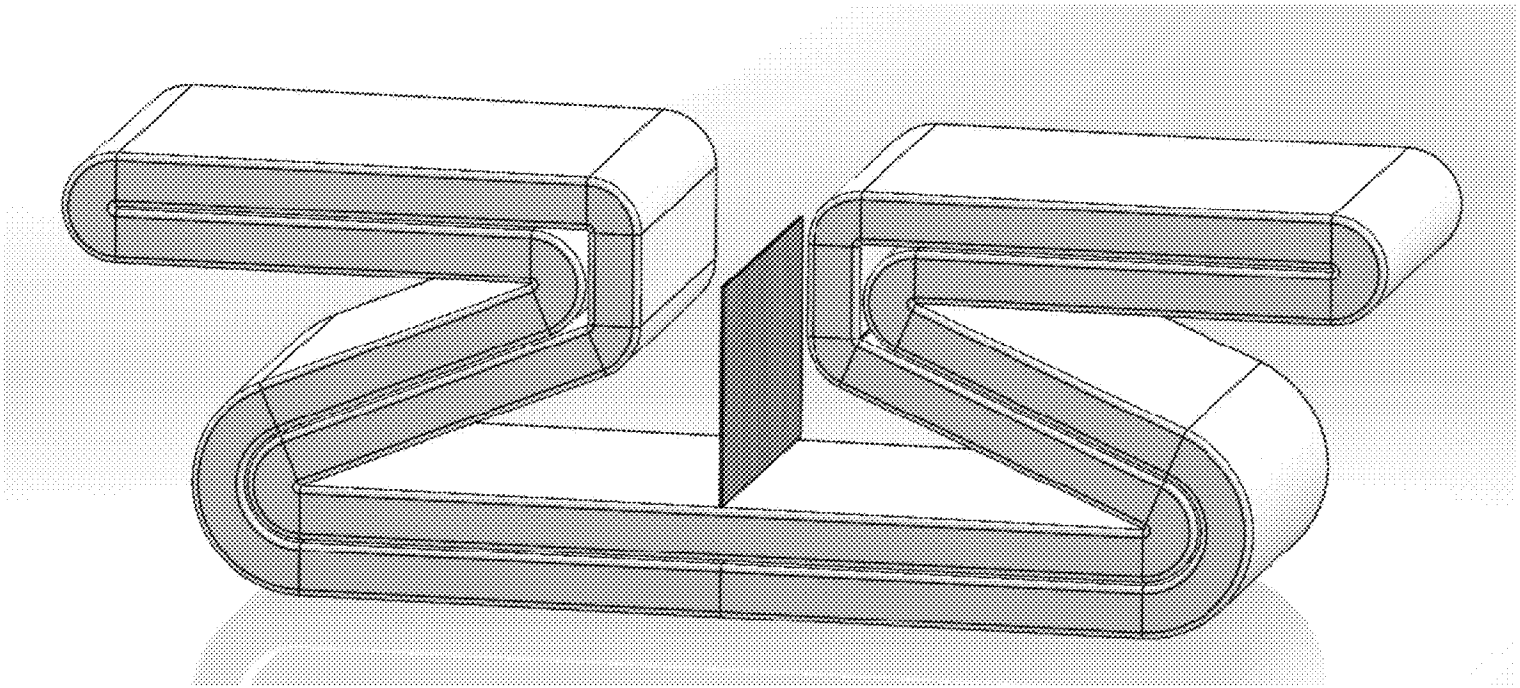
FIG. 3 illustrates one stage in the unpacking of the packed bag.
Figure 4:
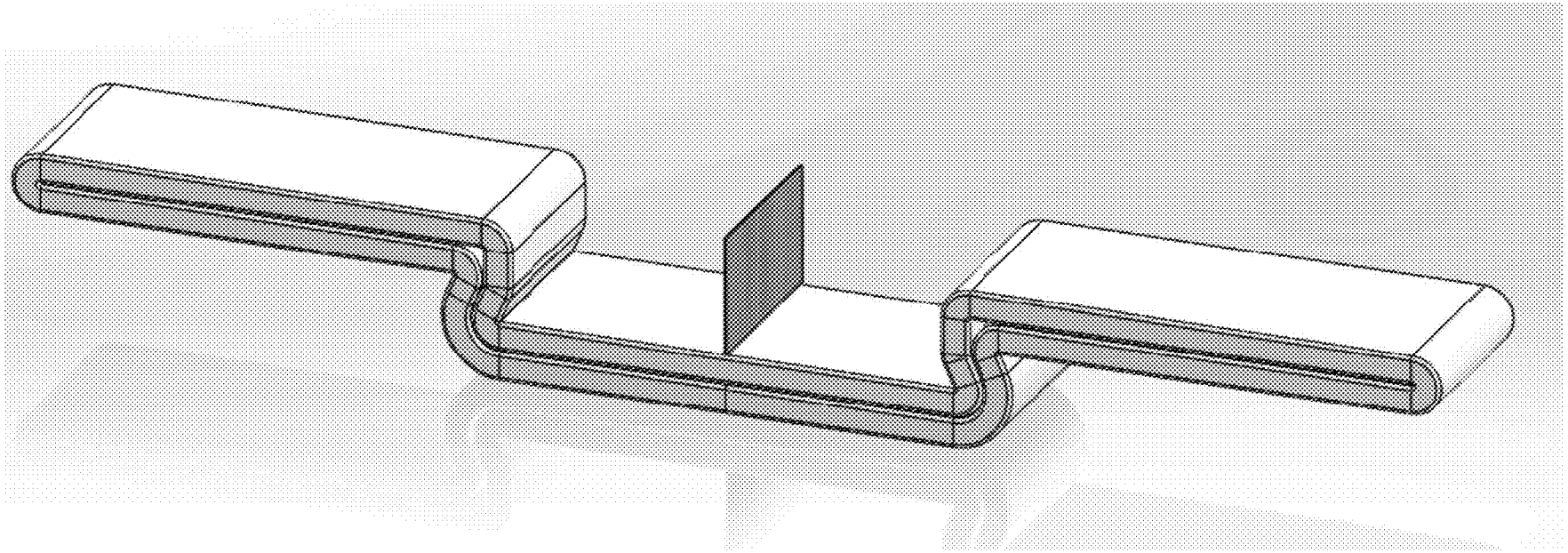
FIG. 4 illustrates a final stage in the unpacking of the packed bag.

Referring to FIGS. 3 and 4, the stages of the unpacking of the bag is illustrated. As can be seen from FIG. 3, after the box is opened such that the left end side and the right end side are both accessible to the user, the left end side and the right end side are pulled or extended to unravel the folded left side and the folded right side. This step stretches the bag in a width-wise manner. The unfolded sides are shown in FIG. 4. This easy unfolding process no longer requires a tedious and physically demanding step of unrolling of the bag and, with the use of the indicator on the outside of the container and the divider, the bag is easily aligned with the loader.

It should be clear that the packed bag in FIG. 2 can be placed in a preferably rigid container (e.g., a cardboard box). Or, depending on the implementation, the bag may be folded inside such a container which is then, in turn, suitably sealed. While the rigidity of the container is not necessary, a rigid container would ensure ease of transportation for the sealed container.

To pack the bag into the above noted box, the process shown in FIGS. 3 and 4 are performed in reverse, starting with FIG. 4. From FIG. 4, the center section 20A of the bag is placed inside a box. From FIG. 3, the left side and the right side of the bag are each then folded over itself without any part of either side overlapping the center 20 of the center section 20A. Once the left side and the right side have been folded, one can then ensure that both the left end side and the right end side are accessible to a user. After this, the box can then be closed to result in a package that includes the folded bulk material bag. The packing of the bag may use one or two cranes to lift the center section into the box and then the left and right sides are folded in its respective side of the box. As noted above, the left side is folded over itself in its side of the box and the right side is folded over itself in its side of the box. This folding of the two sides can be done simultaneously (with the assistance of two cranes) or it can be done in turn (with the assistance of a single crane).

It should be clear that, while the center of the center section of a packed bag is, preferably, coincident with the centerline of a deployed bag (or in-line with or be on the same plane as a longitudinal axis of a deployed bag), this is not necessary. For most grain and silage bags, this center of the center section is clearly marked out on a folded/packed bag. This is so that a user can line up the center with the grain bagger tunnel. Properly aligning with the grain bagger tunnel allows for a stretch mark indicator printed on the bag to be visible to a user as the bag fills up with bulk material. If the center of the center section is not properly aligned with the grain bagger tunnel, there is a risk that the stretch mark indicator may end up at the bottom of the bulk material bag as it fills up with bulk material. Not having a stretch mark indicator that is visible to a user as the bag is filled increases the risk of overfilling the bag and, concomitantly, increases the risk of a burst bag due to overfilling.

It should also be clear that, while FIG. 2 shows that the left side is symmetrical with the right side in terms of size and configuration, this is not a strict requirement. One side can be larger than the other, i.e., the left side can be larger/deeper than the right side or the right side can be larger/deeper than the left side. As well, it should be clear that the left end side and the right end side are accessible to a user who is unpacking the folded bag. The left end side and the right end side can both be accessible to a user as the box is opened or both the left end side and the right end side can be accessible to a user after the box is cut away from the folded bag. Either the left end side or the right end side can, if necessary, be placed to overlap the center of the center section as long as the folded left side and the folded right side are, preferably, not overlapping the center of the center section. The various folds and sections and sides of the folded bag may, of course, be held in place by tape, twine, rope, plastic ties, or any suitable way to ensure that the package inside the box is held together for transport of the box and the folded bag inside.

For greater clarity, the divider is optional but is preferred. The divider ensures that there is division between the folded left side and the folded right side and ensures that that folds of the folded left side does not interfere with the folds of the folded right side and vice versa.

To assist the user who is mounting the bag on to a grain bagger, the box may have an indicator as to the location of the center on the outside of the box. The outside indicator of the center on the box allows the user to place the box such that the center indicator on the box already aligns with the grain bagger. This can be done without even opening the box and, by aligning the center indicator on the outside of the box (with the folded bag inside) with the grain bagger, removes the necessity to move and align the bag with the grain bagger. A box whose external center indicator aligned with the grain bagger ensures that the unpacked/unfolded bag does not need to be aligned to the grain bagger. The aligned box can be opened, the bag unfolded/stretched out widthwise (or diameter-wise), and the mounting of the stretched out bag on the bagger can proceed quickly. As noted above, aligning the center of the center section of the folded bag (by aligning the external center indicator on the box with the grain bagger) ensures that the printed stretch markers on the bag are visible to an operator/user that is filling the bag as the bag deploys.

A person understanding this invention may now conceive of alternative structures and embodiments or variations of the above all of which are intended to fall within the scope of the invention as defined in the claims that follow.

I claim:

1. A packed bulk material bag package in a box, said package comprising:

a bulk material bag in said box wherein said bag comprises:

a center section having a center;

a left side that is folded over itself in said box such that no part of a folded left side substantially overlaps said center;

a right side that is folded over itself in said box such that no part of a folded right side substantially overlaps said center, the left side and the right side distinguishing a width there between;

wherein an end of said left side is adjacent to and facing a left edge of said folded left side;

an end of said right side is adjacent to and facing a right edge of said folded right side; and said bulk material bag is packed in said box with said end of said left side and said end of said right side being accessible to a user such that the user accesses said bag by way of pulling said end of said left side outwards and away from said center and pulling said end of said right side outwards and away from said center, to thereby stretch said bulk material bag in a width-wise manner.

2. The package according to claim 1, wherein said bulk material bag is a grain bag.

3. The package according to claim 1, wherein said bulk material is a silage bag.

4. The package according to claim 1, wherein said center of said package coincides with a central longitudinal axis of a deployed bag.

5. The package according to claim 1, further comprising a divider between said folded left half and said folded right half.

6. The package according to claim 5, wherein said divider is placed substantially at said center of said center section.

7. The package according to claim 1, wherein said folded bag has a center indicator to indicate said center.

8. The package according to claim 7, wherein said center of said bag generally aligns with a central longitudinal axis of a deployed bag.

9. The package according to claim 8, wherein said bag has a stretch indicator that is visible to a user when said bag is deployed and is being filled.

10. The package according to claim 1, wherein said box has a center indicator to indicate said center.

11. The package according to claim 1, wherein said folded left side is not symmetrical to said folded right side.

12. The package according to claim 1, wherein, when unfolded and filled with bulk material, said bag is 8 to 14 feet in diameter and 150 to 500 feet in length.

* * * * *